US005865604A

United States Patent [19]

Kawaguchi et al.

[11] Patent Number: 5,865,604

[45] Date of Patent: Feb. 2, 1999

[54] DISPLACEMENT CONTROLLING STRUCTURE FOR CLUTCHLESS VARIABLE DISPLACEMENT COMPRESSOR

[75] Inventors: Masahiro Kawaguchi; Masanori Sonobe; Ken Suitou; Tomohiko Yokono, all of Kariya, Japan

[73] Assignee: Kabushiki Kaisha Toyoda Jidoshokki Seisakusho, Kariya, Japan

[21] Appl. No.: 661,521

[22] Filed: Jun. 11, 1996

[30] Foreign Application Priority Data

Jun. 13, 1995 [JP] Japan ..... 7-146544

[51] Int. Cl.[6] ..... F04B 1/26

[52] U.S. Cl. ..... 417/222.2

[58] Field of Search ..... 417/222.2

[56] References Cited

U.S. PATENT DOCUMENTS

| | | | |
|---|---|---|---|
| 4,606,705 | 8/1986 | Parekh | 417/222 |
| 5,145,326 | 9/1992 | Kimura et al. | 417/222.2 |
| 5,173,032 | 12/1992 | Taguchi et al. | 417/222.2 |
| 5,286,172 | 2/1994 | Taguchi | 417/222.2 |
| 5,584,670 | 12/1996 | Kawaguchi et al. | 417/222.2 |
| 5,603,610 | 2/1997 | Kawaguchi et al. | 417/222.2 |
| 5,681,150 | 10/1997 | Kawaguchi et al. | 417/222.2 |

FOREIGN PATENT DOCUMENTS

| | | |
|---|---|---|
| 550201 | 7/1993 | European Pat. Off. . |
| 628722 | 12/1994 | European Pat. Off. . |
| 4439512 | 5/1995 | Germany . |
| 337378 | 2/1991 | Japan . |
| 6346845 | 12/1994 | Japan . |
| 127566 | 5/1995 | Japan . |

OTHER PUBLICATIONS

Moran, M.J. and Shapiro, H.N., Fundamental of Engineering Thermodynamics, Wiley & Sons, New York, Fig. 10.9, Dec. 1988.

*Primary Examiner*—Timothy Thorpe
*Assistant Examiner*—Ehud Gartenberg
*Attorney, Agent, or Firm*—Morgan & Finnegan, LLP

[57] ABSTRACT

A variable displacement compressor which has a suction chamber, a discharge chamber, and a crank chamber. The displacement of the compressor is controlled by supplying refrigerant to the crank chamber from the discharge chamber via a pressurizing passage and releasing the gas into the suction chamber via a pressure releasing passage. An increase in the pressure in the crank chamber decreases the displacement, and a decrease in the pressure in the crank chamber increases the displacement. A displacement controlling structure of the compressor includes an electromagnetic valve which alters the size of an area of the pressurizing passage. A computer controls the electromagnetic valve in accordance with commands to alter the displacement. The computer enlarges the opened area of the pressurizing passage by controlling the electromagnetic valve in response to commands to reduce the displacement.

43 Claims, 6 Drawing Sheets

DISPLACEMENT CONTROLLING STRUCTURE FOR CLUTCHLESS VARIABLE DISPLACEMENT COMPRESSOR

BACKGROUND OF THE INVENTION

1. Field of the Invention

The present invention relates to clutchless variable displacement compressors. More particularly, the present invention pertains to controlling the displacement of a compressor by supplying the pressure in a discharge pressure zone to a pressure control chamber through a pressurizing passage while releasing the pressure in the control chamber into a suction pressure zone through a pressure releasing passage.

2. Description of the Related Art

Compressors are typically provided in vehicles to air-condition passenger compartments. Compressors capable of varying their displacement are preferred since they accurately control the temperature inside the passenger compartment and thus allow the environment in the compartment to be maintained at a comfortable level. Such a compressor, that is, a variable displacement compressor, typically has a tiltable swash plate, which is mounted on a shaft. The inclination of the swash plate is controlled based on the difference between the pressure in a crank chamber and the suction pressure. The rotating movement of the swash plate is converted to reciprocating linear movement of pistons.

U.S. Pat. No. 5,173,032, which corresponds to Japanese Unexamined Patent Publication No. 3-37378, describes a piston type compressor that does not employ an electromagnetic clutch. Generally, an electromagnetic clutch connects the compressor's drive shaft to an external drive source for transmission of driving power and disconnects the shaft from the drive source to stop transmission of the power. However, the external drive source and the drive shaft are directly connected to each other in the described compressor.

The elimination of the clutch and direct connection of the drive source with the drive shaft solves the problems of shocks, which would occur when connecting and disconnecting the clutch. By employing such compressors in vehicles, it is possible to provide further comfort to the driver and the passengers when driving the vehicle. Elimination of the clutch reduces the weight of the cooling apparatus and the costs of the compressor.

A typical clutchless compressor is operated even when cooling is unnecessary. When cooling is unnecessary, the displacement of the compressor should be minimized and formation of frost on the evaporator should be prevented. Circulation of refrigerant gas between an external refrigerating circuit and the compressor is stopped when cooling becomes unnecessary or when there is a possibility of formation of frost. The afore-mentioned U.S. Patent describes an electromagnetic valve that blocks the flow of gas from the external circuit to a suction chamber of the compressor and thus stops the circulation of gas between the external circuit and the compressor.

In this prior compressor, the pressure in the suction chamber decreases when the flow of gas from the external circuit to the suction chamber is stopped. This results in a displacement control valve, which detects the pressure in the suction chamber, being completely opened and thus permitting the gas in a discharge chamber to flow into the crank chamber and raise the pressure therein. The gas in the crank chamber is then supplied to the suction chamber. A circulating passage is thus defined extending between cylinder bores, the discharge chamber, the crank chamber, the suction chamber, and the cylinder bores.

The pressure decrease in the suction chamber also lowers the pressure in the cylinder bores. Thus, the difference between the pressure in the crank chamber and the pressure in the cylinder bores becomes large. This minimizes the inclination of the swash plate, which reciprocates the pistons, and results in the displacement becoming minimum. In this state, the drive torque required to operate the compressor becomes minimum and power loss, which occurs when cooling is unnecessary, is minimized.

By closing the electromagnetic valve, the flow of gas from the external refrigerating circuit to the suction chamber is brought to a stop. The electromagnetic valve is attached to an inlet of the compressor, from which refrigerant is introduced. Therefore, since the electromagnetic valve is used together with the control valve, the structure of the compressor is complicated. This results in high costs.

SUMMARY OF THE INVENTION

Accordingly, it is an object of the present invention to provide an inexpensive clutchless variable displacement compressor that has a displacement controlling mechanism of a simple structure.

To achieve this object, a variable displacement compressor has a suction chamber, a discharge chamber and a pressure control chamber. The displacement of the compressor is controlled by supplying a refrigerant via a supply passage from the discharge chamber to the pressure control chamber and delivering the refrigerant via a pressure release passage from the pressure control chamber to the suction chamber. The displacement decreases when the pressure in the pressure control chamber increases. The displacement increases when the pressure in the pressure control chamber decreases. The compressor includes changing means for changing the flow rate of refrigerant in the supply passage, control means for controlling the changing means in response to instructions to increase and instructions to decrease the displacement. The control means controls the changing means to enlarge the amount of opening of the supply passage in response to the instructions to decrease the displacement.

BRIEF DESCRIPTION OF THE DRAWINGS

The features of the present invention that are believed to be novel are set forth with particularity in the appended claims. The invention, together with objects and advantages thereof, may best be understood by reference to the following description of the presently preferred embodiments together with the accompanying drawings in which:

DETAILED DESCRIPTION OF THE PREFERRED EMBODIMENTS

A first embodiment of the present invention according to the present invention will now be described with reference to FIGS. 1 through 5.

Figure 1:
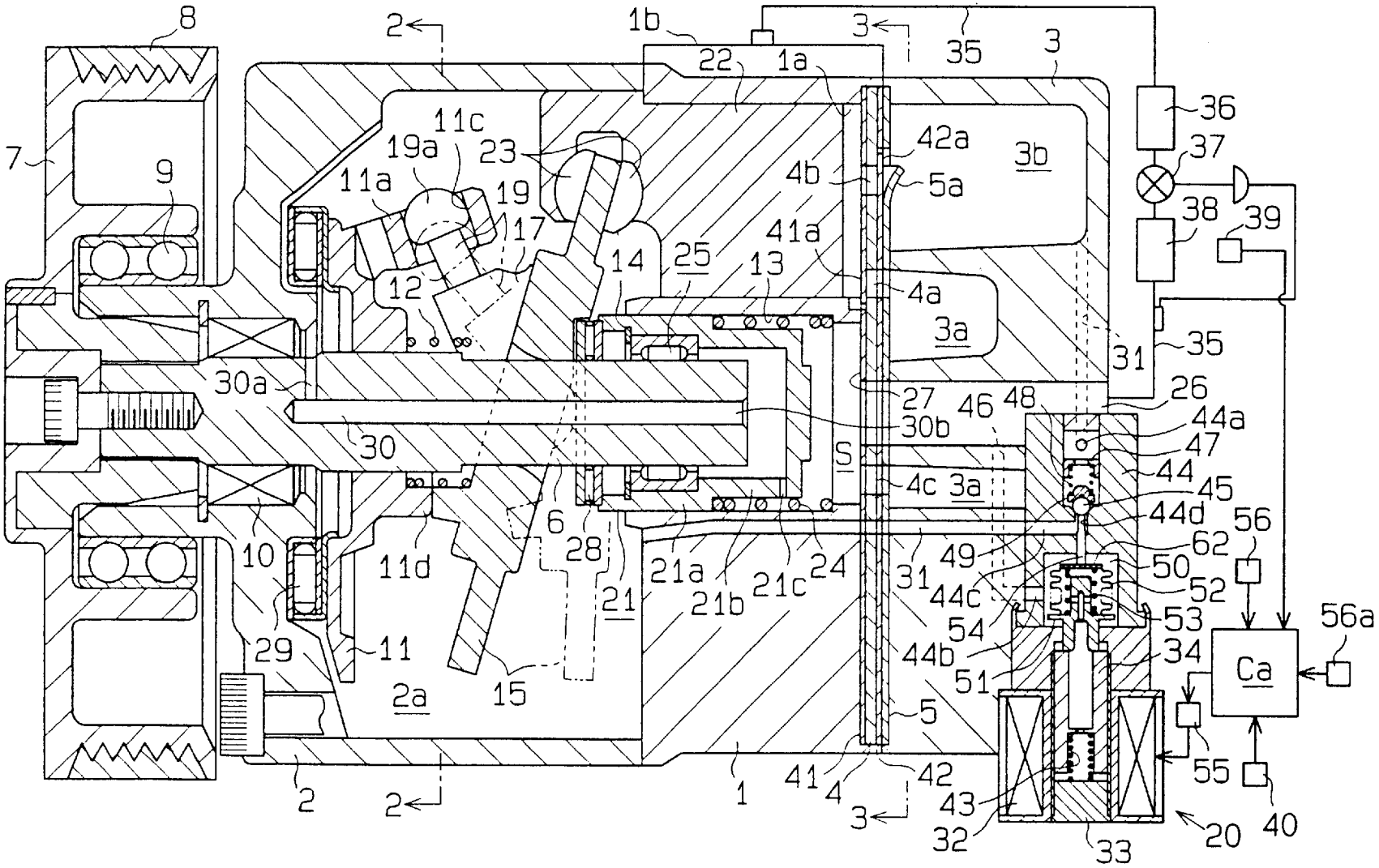
FIG. 1 is a cross-sectional side view of a compressor including a schematic diagram of a refrigeration circuit according to a first embodiment of the present invention.

As shown in FIG. 1, a front housing 2 is coupled to the front end of a cylinder block 1. A rear housing 3 is coupled to the rear end of the cylinder block 1 with first, second, third, and fourth plates 4, 41, 42, 5 fixed therebetween. A pressure control chamber, or crank chamber 2*a*, is defined in the front housing 2. A rotary shaft 6 extends through the front housing 2 and the cylinder block 1 and is rotatably supported. The front end of the shaft 6, which protrudes outward from the crank chamber 2*a*, is secured to a pulley 7. The pulley 7 is operably connected to a vehicle engine (not shown) by a belt 8. The pulley 7 is supported by an angular contact bearing 9 on the front housing 2. Thrust loads and radial loads acting on the pulley 7 are carried by the front housing 2 through the angular-contact bearing 9. A lip seal 10 is arranged between the front end of the shaft 6 and the front housing 2. The lip seal 10 prevents pressure from escaping out of the crank chamber 2*a*.

Figure 2:
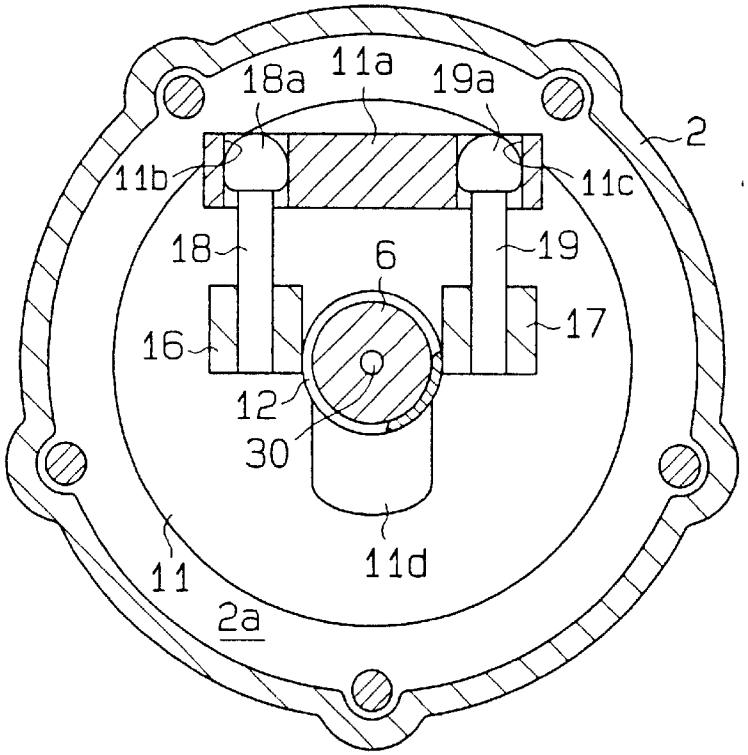
FIG. 2 is a cross-sectional view taken along line 2—2 in FIG. 1.

A drive plate 11 is fixed to the shaft 6. A swash plate 15 is coupled to the drive plate 11 in a manner allowing the swash plate 15 to slide along and tilt with respect to the rotary shaft 6. As shown in FIG. 2, the swash plate 15 is provided with connecting pieces 16, 17. A pair of guide pins 18, 19 is fixed to the connecting pieces 16, 17, respectively. Spherical guide bodies 18*a*, 19*a* are provided on the distal end of the guide pins 18, 19, respectively. A support arm 11*a*, having a pair of guide holes 11*b*, 11*c*, projects from the drive plate 11. The guide bodies 18*a*, 19*a* slidably engage the guide holes 11*b*, 11*c*, respectively. Connection between the support arm 11*a* and the pair of guide pins 18, 19 enables the swash plate 15 to tilt with respect to the shaft 6 and rotate integrally with the shaft 6. The tilting of the swash plate 15 is guided by the engagement between the guide holes 11*b*, 11*c* and the associated guide bodies 18*a*, 19*a*, and by the loose fit of the swash plate 15 with respect to the shaft 6. When the center section of the swash plate 15 approaches the cylinder block 1, the inclination of the swash plate 15 becomes small. The inclination of the swash plate 15 refers to the angle defined between the swash plate 15 and a plane perpendicular to the rotary shaft 6.

A spring 12 is provided between the drive plate 11 and the swash plate 15. The spring 12 urges the swash plate 15 toward the direction in which its inclination is reduced. That is, the swash plate 15 is urged toward perpendicularity to the shaft 6.

Figure 4:
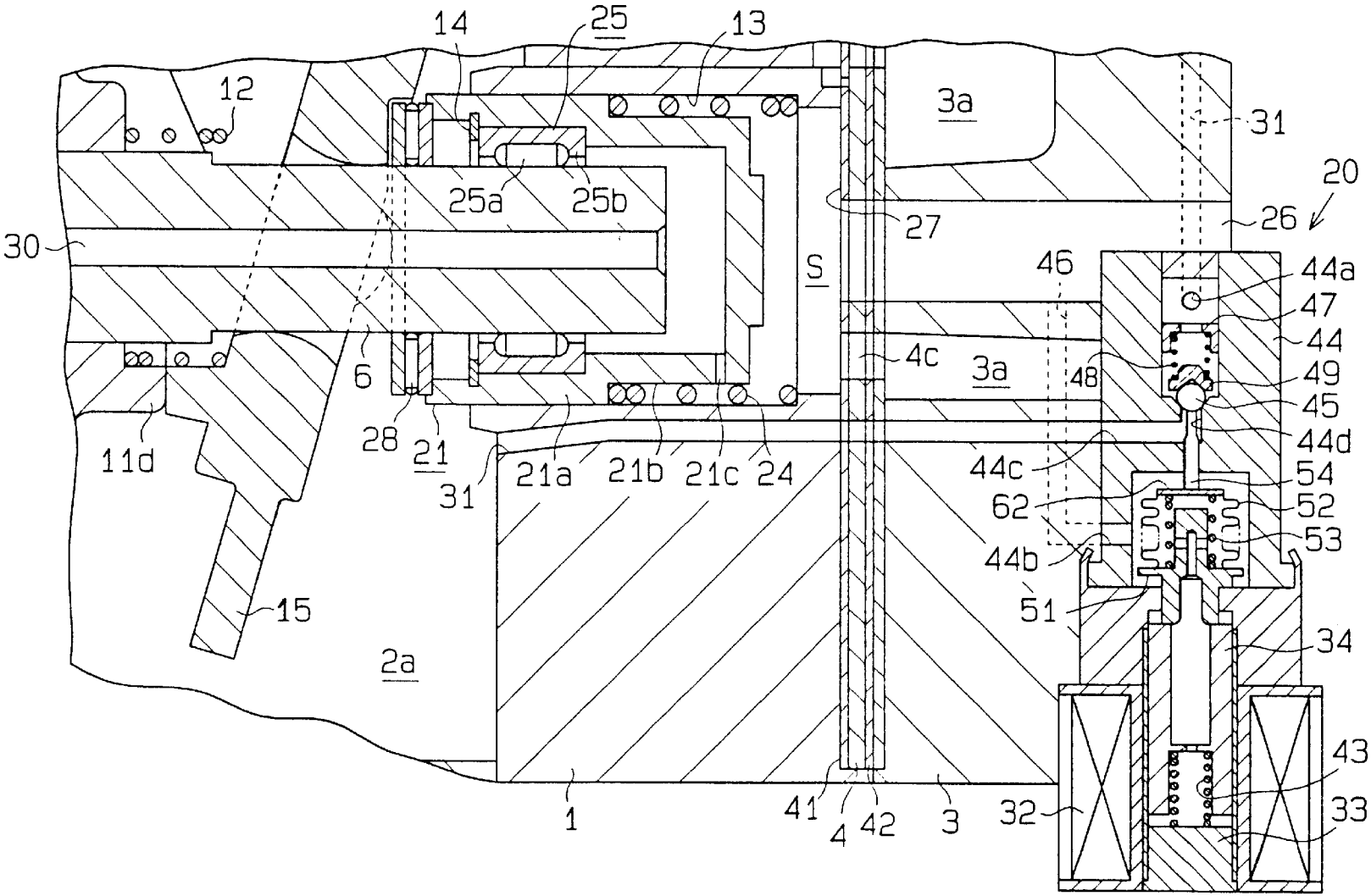
FIG. 4 is an enlarged cross-sectional view showing maximum inclination of the swash plate.
Figure 5:
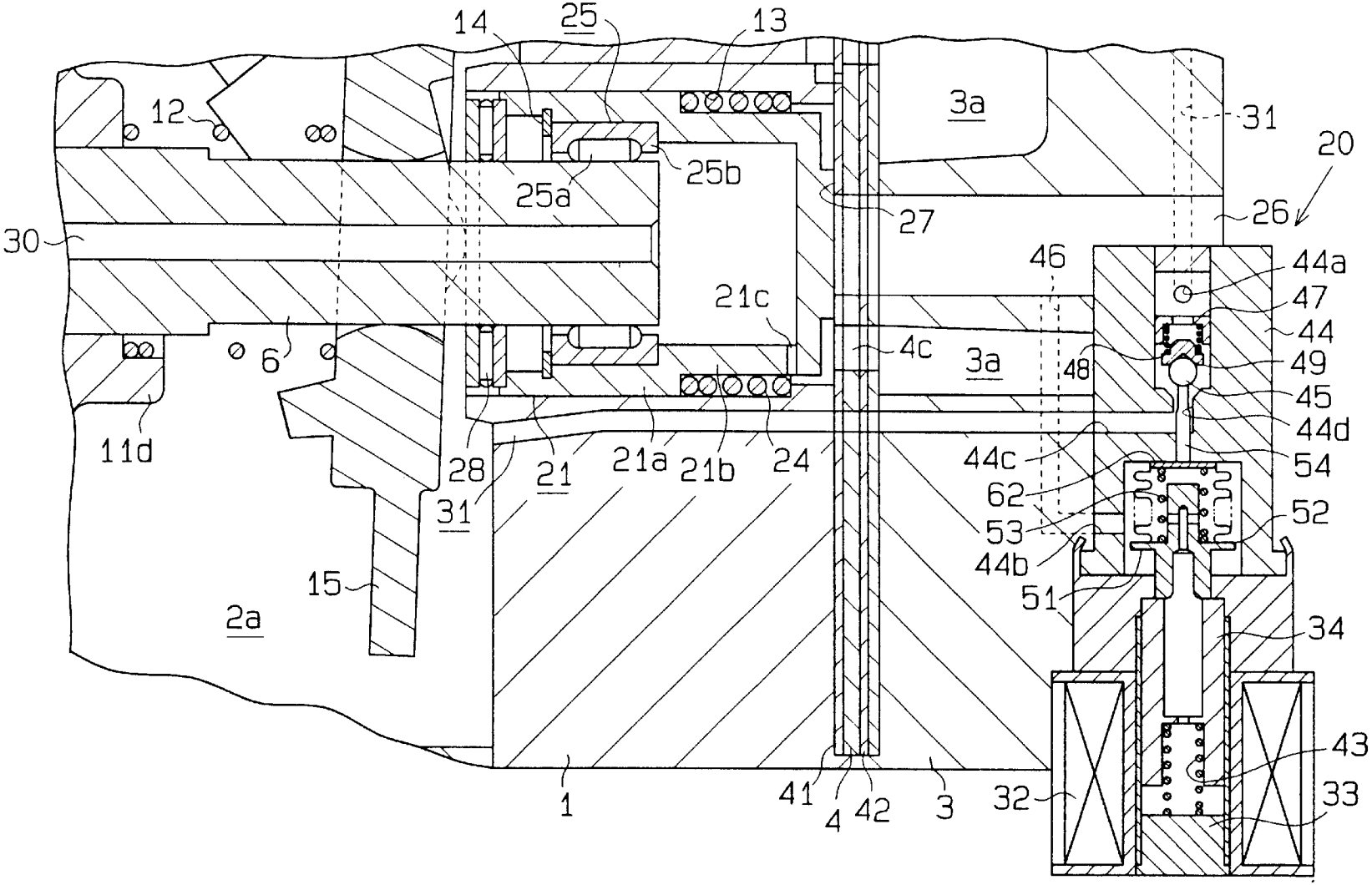
FIG. 5 is an enlarged cross-sectional view showing minimum inclination of the swash plate.

As shown in FIGS. 1, 4, and 5, a retaining hole 13, extending through the cylinder block 1 along the axial direction of the shaft 6, is defined at the center of the cylinder block 1. A cylindrical shutter 21 is slidably fitted in the retaining hole 13. The shutter 21 has a large diameter section 21*a* and a small diameter section 21*b*. A spring 24 is provided between a stepped portion, which is defined between the large diameter section 21*a* and the small diameter section 21*b* and a stepped portion that is defined on the inner surface of the retaining hole 13. The spring 24 urges the shutter 21 toward the swash plate 15.

The rear end of the shaft 6 is inserted into the shutter 21. A radial bearing 25 is fit in the large diameter section 21*a*. The radial bearing 25 includes rollers 25*a* and an outer race 25*b*. The outer race 25*b* is fastened to the inner surface of the large diameter section 21*a*. The rollers 25*a* are slidable with respect to the shaft 6. A snap ring 14, attached to the inner surface of the large diameter section 21*a*, prevents the bearing 25 from falling out of the shutter 21. The rear end of the shaft 6 is supported by the radial bearing 25 and the shutter 21 inside the retaining hole 13.

A suction passage 26 is formed in the center of the rear housing 3. The suction passage 26 extends in the direction of the moving path of the shutter 21, or the axial direction of the shaft 6. The suction passage 26 is connected with the retaining hole 13. A positioning surface 27 is defined on the second plate 41. The surface at the end of the small diameter section 21*b* of the shutter 21 is abuttable against the positioning surface 27. Abutment of the end surface of the small diameter section 21*b* against the positioning surface 27 restricts the shutter 21 from moving further away from the swash plate 15.

A thrust bearing 28 is slidably supported on the shaft 6 between the swash plate 15 and the shutter 21. The thrust bearing 28 is constantly clamped between the swash plate 15 and the shutter 21 by the urging force of the spring 24.

When the swash plate 15 moves toward the shutter 21, the engagement between the swash plate 15 and the thrust bearing 28 causes the shutter 21 to move toward the positioning surface 27 against the urging force of the spring 24. The shutter 21 moves until it abuts against the positioning surface 27. The thrust bearing 28 prevents the rotation of the swash plate 15 from being transmitted to the shutter 21.

A plurality of cylinder bores 1*a* are formed in the cylinder block 1. Each bore 1*a* accommodates a single-headed piston 22. The rotation of the swash plate 15 is transmitted to each piston 22 by way of shoes 23. Accordingly, each piston 22 reciprocates inside the associated bore 1*a*.

Figure 3:
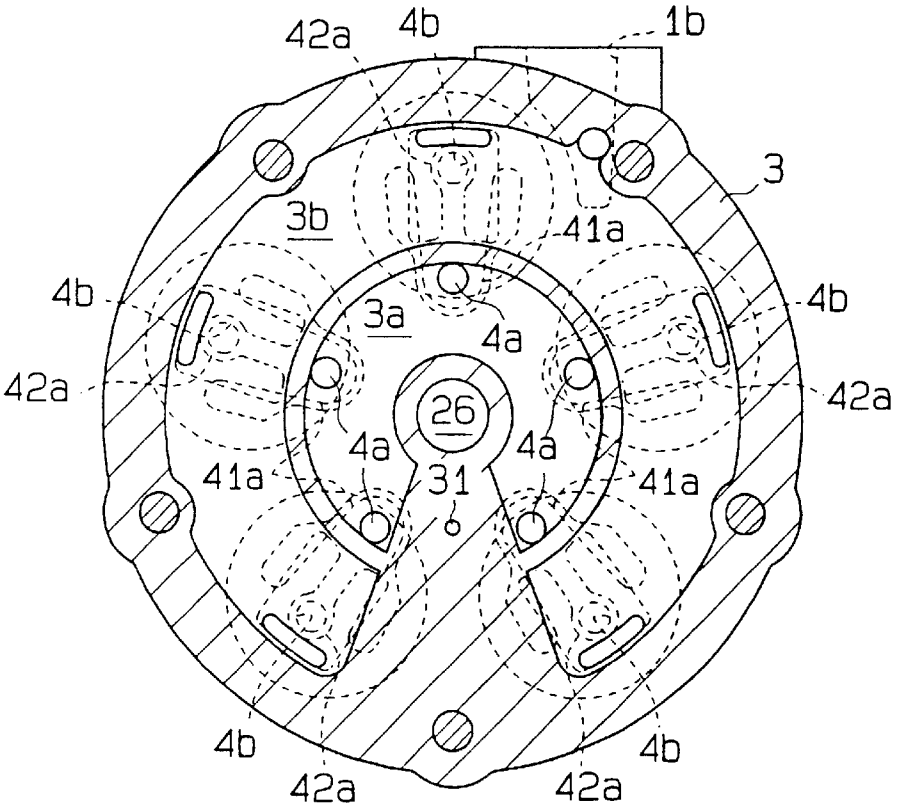
FIG. 3 is a cross-sectional view taken along line 3—3 in FIG. 1.

As shown in FIGS. 1 and 3, a suction chamber 3*a* and a discharge chamber 3*b* are defined in the rear housing 3. Suction ports 4*a* and discharge ports 4*b* are defined in the first plate 4. Suction valves 41*a* are formed in the second plate 41. Discharge valves 42*a* are formed in the third plate 42. Refrigerant gas inside the suction chamber 3*a* flows into each bore 1*a* through the associated suction valve 41*a* when the associated piston 22 moves toward the bottom dead center. The refrigerant gas in the bore 1*a* is discharged into the discharge chamber 3*b* through the discharge valve 42*a* when the piston 22 moves toward the top dead center. Abutment of the discharge valves 42*a* against a retainer 5*a*, provided on the fourth plate 42*a*, restricts the opening of the associated discharge ports 4*b*.

A thrust bearing 29 is provided between the drive plate 11 and the front housing 2. The thrust bearing 29 carries the reaction force that is produced by the gas in the bores 1*a* and transmitted by way of the pistons 22, the shoes 23, the swash plate 15, the connecting pieces 16, 17, the guide pins 18, 19, and the drive plate 11.

The suction chamber 3*a* is connected with the retaining hole 13 through an aperture 4*c*, which extends through the plates 5, 42, 4, 41. Abutment of the shutter 21 against the positioning surface 27 disconnects the aperture 4*c* from the suction passage 26. A conduit 30 is defined inside the shaft 6. The inlet 30*a* of the conduit 30 is connected with the crank chamber 2*a* in the vicinity of the lip seal 10. The outlet 30*b* of the conduit 30 is connected with the inside of the shutter 21. As shown in FIGS. 1, 4, and 5, a pressure releasing hole 21*c* is formed extending through the peripheral wall of the shutter 21. The releasing hole 21*c* connects the inside of the shutter 21 with the retaining hole 13.

As shown in FIG. 1, a pressurizing passageway 31 connects the discharge chamber 3*b* with the crank chamber 2*a*. An electromagnetic valve 20 is provided in the passageway 31. The electromagnetic valve 20 includes a spring 43 that is arranged between a fixed steel core 33 and a movable steel core 34. The movable core 34 is urged away from the fixed core 33 by the spring 43. When a solenoid 32 of the electromagnetic valve 20 is energized, the movable core 34 is moved toward the fixed core 33 against the urging force of the spring 43.

A spheric valve body 45 is retained in a valve housing 44 of the electromagnetic valve 20. First, second, and third ports 44*a*, 44*b*, 44*c* are defined in the valve housing 44. The first port 44*a* is connected to the discharge chamber 3*b* through the passageway 31. The second port 44*b* is connected to the suction passage 26 through a passageway 46 and the third port 44*c* is connected to the crank chamber 2*a* through the passageway 31. A spring 48 and a movable spring support 49 are arranged between a fixed spring support 47 and the valve body 45 inside the valve housing 44. The valve body 45 is thus urged in the direction in which it closes a valve hole 44*d*.

A suction pressure detection chamber 50 is connected with the second port 44*b*. A metal bellows support 51, which is fixed to the movable core 34, is accommodated in the detection chamber 50. A bellows 52 connects the bellows support 51 with a movable spring plate 62. A transmission rod 54 is movably fitted in the housing 44. The bottom end of the rod 54 abuts against the spring plate 62 while the top end abuts against the valve body 45.

The suction passage 26 corresponds to the inlet of the suction chamber 3*a* from which refrigerant gas is introduced. An outlet 1*b*, through which refrigerant gas from the discharge chamber 3*b* is discharged, is provided in the cylinder block 1. An external refrigerant circuit 35 connects the outlet 1*b* to the suction passage 26. The refrigerant circuit 35 includes a condenser 36, an expansion valve 37, and an evaporator 38. The expansion valve 37 controls the flow rate of the gas in accordance with the fluctuation of the gas temperature at the outlet'side of the evaporator 38. A temperature sensor 39 is located in the vicinity of the evaporator 38. The temperature sensor 39 detects the temperature of the evaporator 38 and sends a signal corresponding to the detected temperature to a computer C*a*.

The solenoid 32 of the electromagnetic valve 20 is controlled by the computer C*a* through a driving circuit 55. The computer C*a* controls the value of the electric current that flows through the solenoid 32 based on the signal from the temperature sensor 39. A temperature controller 56, through which the desired temperature of the vehicle's passenger compartment is set, is connected to the computer C*a*. A temperature sensor 56*a* detects the temperature in the passenger compartment and sends the detected result to the computer C*a*. The computer C*a* determines the value of the electric current, which is to flow through the solenoid 32, from the temperature value set by the temperature controller 56 and the temperature value detected by the temperature sensor 39. The computer C*a* then sends commands to the driving circuit 55 to energize the solenoid 32 with the electric current flowing at the determined value.

The solenoid 32, the bellows 52, and the valve body 45 constitute an apparatus for altering the opened area of the valve hole 44d, or the cross-sectional area of the passageway 31. The computer C*a* and the driving circuit 55 constitute an apparatus that controls the altering apparatus.

The computer C*a* de-energizes the solenoid 32 when the temperature of the evaporator 38, detected by the temperature sensor 39, becomes equal to or lower than a predetermined value while a switch 40, which activates the air-conditioning apparatus, is turned on. There is a possibility of frost forming when the temperature of the evaporator 38 becomes equal to or lower than the predetermined value. The solenoid 32 is also de-energized when the switch 40 is turned off.

When the switch 40 is turned on and the temperature in the passenger compartment, detected by the temperature sensor 56*a*, becomes equal to or higher than the value set by the temperature controller 56, the computer C*a* sends commands to the driving circuit 55 to energize the solenoid 32. This causes a determined value of electric current to flow through the solenoid 32. The energized solenoid 32 draws the movable core 34 toward the fixed core 33 against the urging force of the spring 43 in accordance with the value of the flowing electric current. This drawing force is transmitted to the rod 54 by way of the bellows support 51 and the bellows 52 and moves the rod 54 in a downward direction away from the valve body 45. In other words, the drawing force acts on the valve body 45 and moves the body 45 in the direction in which it reduces the opened area of the valve hole 44*d*. The upper end of the bellows 52 is displaced in accordance with the pressure of the gas drawn into the detection chamber 50 from the suction passage 26 by way of the passageway 46. This displacement is transmitted to the valve body 45 through the rod 54. In addition, since the spring 53 urges the rod 54 in an upward direction with the spring plate 62, the opened area of the valve hole 44*d* is determined in accordance with the drawing force acting on the movable core 33, the urging force of the springs 43, 48, and 53, and the pressures of the discharged gas and the drawn gas.

A large difference between the temperature in the passenger compartment, which is detected by the temperature sensor 56*a*, and the temperature set by the temperature controller 56 indicates that cooling is greatly needed. In such a case, the computer C*a* adjusts the value of the electric current that flows through the solenoid 32 in accordance with the temperature difference to alter the suction pressure. For example, the computer C*a* increases the electric current value as the detected temperature becomes higher. Accordingly, the drawing force with respect to the movable core 34 becomes stronger and causes the core 34 to move from the position shown in FIG. 5 to the position shown in FIG. 4. As a result, the force produced by the spring 48 and the force of the pressure of the discharged gas in a direction closing the valve hole 44*d* becomes superior to the force produced by the bellows 52 and the spring 53 in a direction opening the valve hole 44*d*. In this state, it is required that the force of the pressure in the detection chamber 50, namely, the suction pressure, be inferior to the urging force of the spring 53 to enlarge the opened space of the valve hole 44*d*. In other words, by increasing the value of the electric current flowing through the electromagnetic valve 20, it is possible to control the opened area of the valve hole 44*d* when the suction pressure is low. Hence, the cross-sectional area of the passageway 31 is controlled in accordance with low suction pressure by supplying a large electric current to the electromagnetic valve 20. Accordingly, by reducing the setting suction pressure of the electromagnetic valve 20, the cooling ability of the refrigerant circuit is improved.

As the area of the valve hole 44*d* opened by the valve body 45 becomes small, the amount of refrigerant gas introduced into the crank chamber 2*a* from the discharge chamber 3*b* through the pressurizing passageway 31 becomes small. The refrigerant gas in the crank chamber 2*a* flows into the suction chamber 3*a* by way of the conduit 30, the shutter 21, and the pressure releasing hole 21*c*. This lowers the pressure in the crank chamber 2*a*. When cooling is greatly needed, the suction pressure in each cylinder bore 1*a* is high. Thus, the difference between the pressure in the crank chamber 2*a* and the pressure in the cylinder bores 1*a* becomes small and increases the inclination of the swash plate 15.

When the passageway 31 is closed by the valve body 45, the highly pressurized refrigerant gas in the discharge chamber 3*b* stops flowing into the crank chamber 2*a*. Therefore, the pressure in the crank chamber 2*a* becomes substantially the same as the pressure in the suction chamber 3*a*. This causes the inclination of the swash plate 15 to become maximum. The maximum inclination of the swash plate 15 is restricted by the abutment between the swash plate 15 and a restricting projection lid protruding from the drive plate 11. When such abutment occurs, the displacement of the compressor is maximum.

Contrarily, when the requirement for cooling becomes low, the difference between the temperature in the passenger compartment, which is detected by the temperature sensor 56*a*, and the temperature set by the temperature controller 56 becomes small. The lower the detected temperature is, the lower the computer C*a* outputs the electric current value. Accordingly, the drawing force with respect to the movable core 34 becomes small. This results in the force produced by the spring 48 and the pressure of the discharged gas in a direction closing the valve hole 44*d* to become slightly superior to the force produced by the bellows 52 and the spring 53 in a direction opening the valve hole 44*d*. In this case, to increase the opened area of the valve hole 44*d*, it is required that the force of the pressure in the detection chamber 50 be just slightly smaller than the urging force of the spring 53. Thus, the opened area of the valve hole 44*d* may be enlarged even if the suction pressure is higher relative to the suction pressure when cooling is greatly needed. This allows the cross-sectional area of the passageway 31 to be adjusted in accordance with the high suction pressure by controlling the electric current flowing into the electromagnetic valve 20 at a low value.

As the area of the valve hole 44*d* opened by the valve body 45 becomes large, the amount of refrigerant gas flowing into the crank chamber 2*a* from the discharge chamber 3*b* becomes great and thus the pressure in the crank chamber 3*b* is increased. In addition, when the requirement for cooling is small, the suction pressure in each cylinder bore 1*a* is small. Thus, the difference between the pressure in the crank chamber 2*a* and the pressure in the cylinder bores 1*a* becomes large and decreases the inclination of the swash plate 15.

When the cooling requirement becomes low, the temperature of the evaporator 38 decreases and approaches the predetermined temperature. When the detected temperature becomes equal to or lower than the predetermined temperature, the computer C*a* sends commands to de-energize the solenoid 32. By de-energizing the solenoid 32, the valve body 45 opens the entire valve hole 44*d*. This results in a large amount of the highly pressurized refrigerant gas in the discharge chamber 3*b* to flow into the crank chamber 2*a* through the pressurizing passageway 31 and thus increase the pressure in the crank chamber 2*a*. The pressure increase in the crank chamber 2*a* causes the inclination of the swash plate 15 to become minimum as shown in FIG. 5. Furthermore, when the switch 40 is turned off, the computer de-energizes the solenoid 32. The inclination of the swash plate 15 also becomes minimum in this case.

Detection of temperature signals indicating that the temperature of the evaporator 38 (or of the passenger compartment) is lower than the predetermined value constitutes signals for minimizing the displacement of the compressor. A signal indicating that the switch 40 is turned off constitutes a signal for minimizing the displacement. Based on these signals, the computer C*a* controls the value of the electric current that flows through the solenoid 32 to forcibly minimize the displacement of the compressor. Signals indicating that the detected temperature exceeds the predetermined value constitute the signals for varying or increasing the displacement of the compressor. Based on these signals, the computer C*a* controls the value of the electric current that flows through the solenoid 32 to vary the displacement and alter the suction pressure. The computer C*a* serves as a controller that controls the value of the electric current supplied to the solenoid 32 to forcibly minimize the displacement in response to minimum displacement commands. The computer C*a* also controls the value of the electric current supplied to the solenoid 32 to alter the suction pressure.

The area of the valve hole 44*d* opened by the valve body 45 is altered in accordance with the value of the electric current flowing through the solenoid 32. As the electric current value becomes large, the opened area of the valve hole 44*d* becomes small, and as the electric current value becomes small, the area of the valve hole 44*d* becomes large. When the opened area of the valve hole 44*d* becomes large, the pressure in the crank chamber 2*a* is increased and the displacement becomes small. When the opened area of the valve hole 44*d* becomes small, the pressure in the crank chamber 2*a* is decreased and the displacement becomes large. In other words, the electromagnetic valve 20, which changes the cross-sectional area of the passageway 31, constitutes an apparatus for changing the suction pressure. Suction pressure acts on the bellows 52 by way of the suction passage 26 and the passageway 46. Discharge pressure acts on the rod 54 together with the urging force of the spring 48 by way of the valve body 45. That is, the difference between the discharge pressure at the side of the valve body 45 and the suction pressure at the side of the detection chamber 50 acts on the rod 54. The pressure difference acts on the rod 54 in the direction in which the opened area of the valve hole 44*d* becomes small. Accordingly, the suction pressure becomes small when the discharge pressure is high, and the suction pressure becomes high when the discharge pressure is low. Such suction pressure controlling characteristics are important from the viewpoints of the cooling performance and the prevention of frost.

When the inclination of the swash plate 15 becomes minimum, the shutter 21 abuts against the positioning surface 27 and closes the suction passage 26. The shutter 21, which is moved by the inclination of the swash plate 15, gradually narrows the space S, which is defined in the retaining hole 13 and is continuous with the suction passage 26. The slow change in the dimension of the space S gradually decreases the flow rate of the refrigerant gas that flows into the suction chamber 3*a* from the suction passage 26. This, in turn, gradually reduces the amount of refrigerant gas drawn into the cylinder bores 1*a* from the suction chamber 3*a* and thus gradually reduces displacement of the compressor. Therefore, the discharge pressure decreases gradually and a sudden and dramatic fluctuation in the load torque of the compressor is prevented. Accordingly, the load torque of the clutchless compressor fluctuates gradually as the displacement varies from maximum to minimum, and thus, the impact caused by fluctuation in the load torque is reduced.

When the shutter 21 abuts against the positioning surface 27, the suction passage 26 closes, and the flow of refrigerant gas from the external refrigerating circuit to the suction chamber 3*a* thus becomes blocked. The minimum inclination of the swash plate 15 is restricted by the abutment between the shutter 21 and the positioning surface 27. In this manner, the positioning surface 27, the shutter 21, the thrust bearing 28, and the swash plate 15 constitute an apparatus for determining the minimum inclination. The minimum inclination of the swash plate is set at an angle slightly greater than zero degrees with respect to the plane perpendicular to the axis of the shaft 6.

It is necessary to move the shutter 21 to a closing position where it disconnects the suction passage 26 from the retaining hole 13 to arrange the swash plate 15 at the minimum inclination. The shutter 21 is moved by the swash plate 15 between the closing position and an opening position.

Since the minimum inclination of the swash plate 15 is not zero degrees, refrigerant gas is discharged into the discharge chamber 3*b* from the cylinder bores 1*a* even when the inclination of the swash plate 15 is minimum. This refrigerant gas then flows into the crank chamber 2*a* via the pressurizing passageway 31. The refrigerant gas inside the crank chamber 2*a* flows into the suction chamber 3*a* via the pressure releasing passage composed of the conduit 30 and the pressure releasing hole 21*c*. This gas is then drawn into the bores 1*a* and subsequently discharged into the discharge chamber 3*b*. In other words, when the inclination of the swash plate 15 is minimum, a circulating passage is defined extending between the discharge chamber (discharge pressure zone) 3*b*, the pressurizing passageway 31, the crank chamber 2*a*, the conduit 30, the pressure releasing hole 21*c*, the retaining hole 13, the suction chamber (suction pressure zone) 3*a*, and the cylinder bores 1*a*. In this state, a pressure difference is produced between the discharge chamber 3*b*, the crank chamber 2*a*, and the suction chamber 3*a*. Therefore, the refrigerant gas circulates through the circulation passage and lubricates the inside of the compressor with the lubricating oil included in the gas.

In the case that the requirement for cooling becomes high during a state in which the switch 40 is turned on and the inclination of the swash plate 15 is minimum, the temperature of the evaporator 38 increases. Hence the detected temperature of the evaporator 38 exceeds the predetermined value. The computer C*a* de-energizes the solenoid 32 in accordance with the change in the detected temperature. This closes the pressurizing passageway 31 and decreases the pressure in the crank chamber 2*a* by releasing pressure through the conduit 30 and the pressure releasing hole 21*c*. The spring 24 thus expands from the contracted state shown in FIG. 5 and moves the shutter 21 away from the positioning surface 27 to increase the inclination of the swash plate 15. As the shutter 21 moves, the volume of the space S defined between the shutter 21 in the retaining hole 13 and the positioning surface 27 gradually increases. This gradually increases the amount of refrigerant gas that flows into the suction chamber 3*a* from the suction passage 26. Accordingly, the amount of refrigerant gas drawn into the cylinder bores 1*a* from the suction chamber 3*a* gradually increases. This, in turn, gradually increases the displacement of the compressor. Hence, the discharge pressure is gradually increased without a sudden and dramatic change in the load torque of the compressor. As a result, the load torque of the clutchless compressor fluctuates gradually as its displacement varies from minimum to maximum, and thus, the impact caused by fluctuation in the load torque is reduced.

When the operation of the vehicle engine is stopped, the operation of the compressor is stopped. Thus, the swash plate 15 stops rotating and the electromagnetic valve 20 becomes de-energized. The de-energized electromagnetic valve 20 causes the inclination of the swash plate to become minimum. If the operation of the compressor remains in a stopped state, the pressure in the compressor becomes uniform. However, the urging force of the spring 12 maintains the swash plate 15 at the minimum inclination. Accordingly, when the engine is started and the compressor commences operation, the swash plate 15 starts rotating from the position of the minimum inclination. When the inclination is minimum, the load torque is also minimum. Thus, the shock caused during the commencement of the operation of the compressor is minimized.

The clutchless variable displacement compressor, which controls displacement and has the structure described above, includes an electromagnetic valve 20 having the functions of both the electromagnetic valve and the displacement control valve, which are described in Japanese Unexamined Patent Publication No. 3-37378. The constitution of this clutchless variable displacement compressor enables simplification of the displacement controlling structure and reduction in costs.

Figure 6:
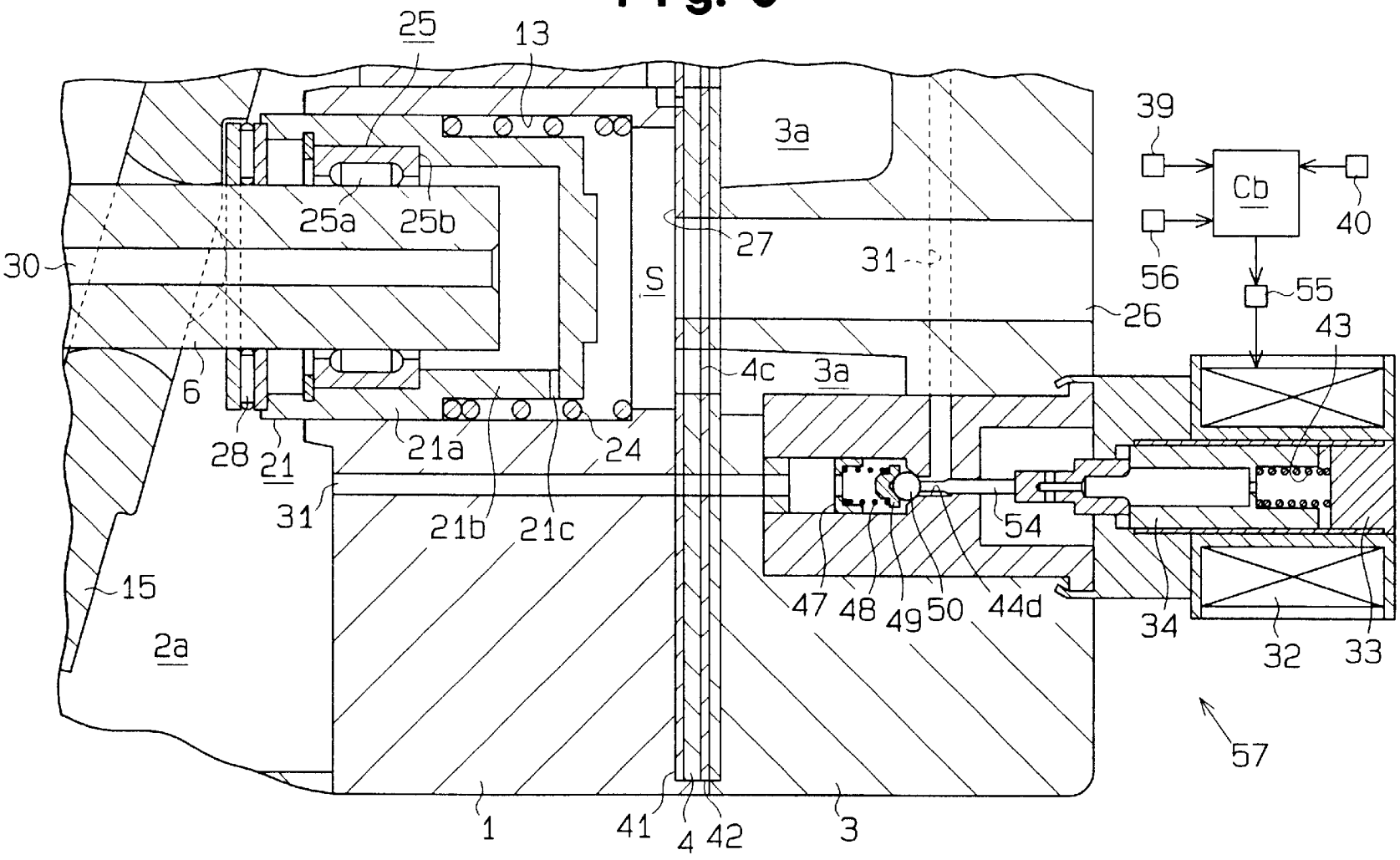
FIG. 6 is an enlarged cross-sectional view including schematic portions showing a second embodiment of the present invention.

A second embodiment of the present invention will now be described with reference to FIG. 6. Parts having the same function as those in the first embodiment are denoted with the same reference numerals. In this embodiment, an electromagnetic valve 57 is controlled by the computer C*b*. The computer C*b* computes the value of the electric current, which is to flow through the solenoid 32, based on the passenger compartment temperature, set by the temperature controller 56, and the temperature detected by the temperature sensor 39. Although the electromagnetic valve 57 is not provided with the bellows mechanism employed in the valve of the first embodiment, the computer C*b* controls the value of the electric current that flows through the electromagnetic valve 57 to decrease the suction pressure when the discharge pressure is high and increase the suction pressure when the discharge pressure is low in the same manner as the computer C*a* used in the first embodiment.

This embodiment enables the same advantageous effects of the first embodiment to be obtained. Additionally, the internal structure of the electromagnetic valve 57 is further simplified in comparison with the electromagnetic valve 20 of the first embodiment.

Figure 7:
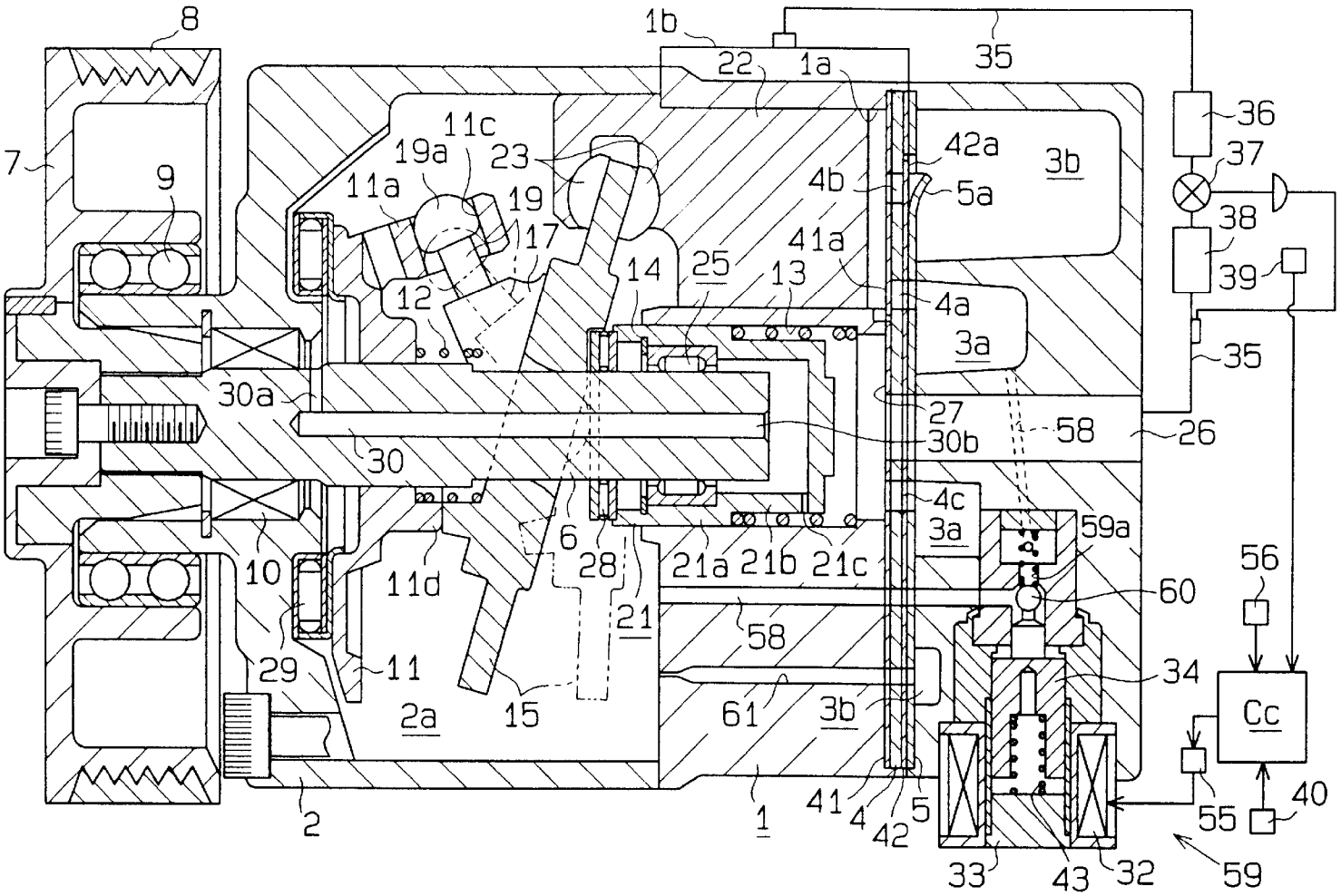
FIG. 7 is an enlarged cross-sectional view including schematic portions showing a third embodiment of the present invention.

A third embodiment of the present invention will now be described with reference to FIG. 7. Parts having the same function as those in the first embodiment are denoted with the same reference numerals. The crank chamber 2*a* is connected to the suction chamber 3*a* by the pressure releasing passage 58. An electromagnetic valve 59 is provided in the passage 58. When the solenoid 32 of the electromagnetic valve 59 is de-energized, a valve body 60 closes a valve hole 59*a*. When the solenoid 32 is energized, the valve body opens the valve hole 59*a*. The discharge chamber 3*b* is connected to the crank chamber 2*a* by a pressurizing passage 61. The refrigerant gas in the discharge chamber 3*b* is constantly supplied to the crank chamber 2*a* through the passage 61.

A computer C*c* computes the opened area of the valve hole 59*a* in the electromagnetic valve 59, based on the temperature in the passenger compartment that is set by the temperature controller 56, and the temperature detected by the temperature sensor 39. In this embodiment, as the requirement for cooling becomes higher, the computer C*c* increases the electric current value. Thus, when cooling is greatly needed, the opened area of the valve hole 59*a* is increased and the pressure in the crank chamber 2*a* is decreased. Contrarily, when the requirement for cooling becomes low, the opened area of the valve hole 59 is decreased and the pressure in the crank chamber 2*a* is increased. The computer C*c* controls the value of the electric current that flows through the electromagnetic valve 59 to decrease the suction pressure when the discharge pressure is high and increase the suction pressure when the discharge pressure is low. The computer C*c* serves as a controller that controls the value of the electric current supplied to the solenoid 59 to reduce the displacement in response to displacement reduction commands. The computer C*c* also controls the value of the electric current supplied to the solenoid 59 to alter the suction pressure. Accordingly, this embodiment allows the same advantageous effects of the second embodiment to be obtained.

Although only three embodiments of the present invention have been described herein, it should be apparent to those skilled in the art that the present invention may be embodied in many other specific forms without departing from the spirit or scope of the invention. Therefore, the present examples and embodiments are to be considered as illustrative and not restrictive and the invention is not to be limited to the details given herein, but may be modified within the scope of the appended claims.

What is claimed is:

1. A variable displacement compressor comprising: a suction chamber; a discharge chamber; a pressure control chamber; a supply passage interconnecting said discharge chamber with said pressure control chamber; a pressure release passage interconnecting said pressure control chamber with said suction chamber; inlet means for coupling a refrigerating circuit outlet to said suction chamber for supplying a gaseous refrigerant from said refrigerating circuit to said suction chamber; means for drawing gaseous refrigerant from said suction chamber, subjecting it to compression, and discharging compressed gaseous refrigerant to said discharge chamber; the displacement of said compressor being controlled by supplying said gaseous refrigerant through said supply passage from said discharge chamber to said pressure control chamber and delivering said refrigerant through said pressure release passage from said pressure control chamber to said suction chamber, said displacement decreasing when the pressure in said pressure control chamber increases, and said displacement increasing when the pressure in said pressure control chamber decreases; a valve having a valve seat, a valve body, and means including a solenoid coupled to said valve body for moving said valve body continuously relative to said valve seat for changing the flow rate of said gaseous refrigerant through at least one of said supply and pressure release passages as a function of the energization of said solenoid between a first position for establishing maximum displacement of said compressor and a second position for establishing minimum displacement of said compressor; and a controller coupled thereto for controlling said solenoid; said controller and said valve being constructed for positioning said valve body at said first and second positions and at all positions in-between, whereby said suction pressure within said suction chamber can be adjusted over a predetermined range by said controller.

2. A compressor according to claim 1 further comprising:

a casing containing said discharge chamber and said suction chamber;

a crank chamber defined in said casing, said crank chamber serving as said pressure control chamber;

a plurality of cylinder bores formed in said casing, each cylinder bore being connected to said discharge chamber and said suction chamber;

a plurality of pistons accommodated in said cylinder bores, respectively;

a rotary shaft rotatably supported by said casing; and a swash plate supported on said rotary shaft for integral rotation with and inclining motion with respect to said rotary shaft, wherein said pistons draw said refrigerant into said cylinder bores from said suction chamber, compress said refrigerant and then discharge said refrigerant to said discharge chamber, and wherein the inclined angle of said swash plate is varied according to the pressure in said crank chamber and the displacement is altered according to the resulting inclined angle of said swash plate.

3. A compressor according to claim 2, wherein said supply passage connects said discharge chamber to said crank chamber, and wherein said valve is located in said supply passage.

4. A compressor according to claim 3, wherein said controller includes a computer for controlling said solenoid valve.

5. A compressor according to claim 3, wherein said valve includes:

a valve housing;

said solenoid being located within said valve housing;

a plunger actuated when a current is supplied to said solenoid;

a valve hole formed in said valve housing extending from said valve seat and located in said supply passage; and said valve body being coupled for adjusting the opening of said valve hole in accordance with the activation of said plunger.

6. A compressor according to claim 5, wherein said controller includes a computer for controlling the magnitude of the current supplied to said solenoid of said valve.

7. A compressor according to claim 5, wherein said inlet means comprises a suction passage defined in said casing and connected to said suction chamber, said compressor further comprising:

outlet means for coupling a refrigerating circuit inlet to said discharge chamber for supplying compressed gas to said refrigerating circuit;

a shutter member movably supported by said casing for opening and closing said suction passage according to the movement of the shutter member, said shutter member moving in accordance with the inclining movement of said swash plate.

8. A compressor according to claim 7, wherein said valve further includes:

a detection chamber defined between said solenoid and said valve hole in said valve housing for detecting the pressure of said gas within said suction passage; and a pressure sensing member located in said detection chamber for transmitting the movement of said plunger, said pressure sensing member expanding and contracting in response to the pressure in said detection chamber.

9. A compressor according to claim 8, wherein said pressure release passage includes:

a passage formed in said rotary shaft; and a pressure release hole formed in said shutter member and connected to said last mentioned passage.

10. A compressor according to claim 1, wherein the controller is coupled to means for sensing the temperature in a passenger compartment of a vehicle when the compressor is mounted on said vehicle.

11. A compressor according to claim 1, wherein:

said valve is located in said supply passage;

a pressure sensing member is provided responsive to a suction pressure for transmitting variation of said suction pressure to said valve body; and said controller controls the value of a current supplied to said solenoid such that the displacement of said valve body is changed to the minimum in response to minimum displacement instructions and wherein said controller controls the value of the current supplied to said solenoid to change the suction pressure.

12. A compressor according to claim 1, wherein said means for moving said valve body relative to said valve seat includes means responsive to pressure coupled to both said solenoid and said valve body for moving said valve body jointly with said solenoid.

13. A compressor according to claim 12, wherein said means responsive to pressure comprises a sealed bellows internally biased by a spring under compression and coupled between said solenoid and said valve body such that the displacement of said valve body is equal to the pressure responsive expansion and contraction of said bellows added algebraically to the displacement of said solenoid.

14. A compressor according to claim 1, wherein said first position of said valve is fully closed and said second position of said valve is fully open.

15. A compressor according to claim 1, wherein said first position of said valve is fully open and said second position of said valve is fully closed.

16. A compressor according to claim 1, further comprising a temperature detection sensor for detecting the temperature in a passenger compartment of a vehicle when the compressor is mounted in the vehicle, and a temperature setting device for presetting the temperature in the passenger compartment.

17. A compressor according to claim 16, further comprising comparing means for comparing the temperature detected by the temperature detection sensor with the preset temperature.

18. A variable displacement compressor having a suction chamber, a discharge chamber and a pressure control chamber, the displacement of a refrigerant from the compressor being controlled by supplying said refrigerant via a supply passage from said discharge chamber to said pressure control chamber and delivering said refrigerant via a pressure release passage from said pressure control chamber to said suction chamber, wherein said displacement decreases when the pressure in said pressure control chamber increases and said displacement increases when the pressure in said pressure control chamber decreases, said compressor further comprising:

a casing having said discharge chamber and said suction chamber;

a crank chamber defined in said casing, said crank chamber serving as said pressure control chamber;

a plurality of cylinder bores formed in said casing, each cylinder bore being connected to said discharge chamber and said suction chamber;

a plurality of pistons accommodated each in a different one of said cylinder bores;

a rotary shaft rotatably supported by said casing; and a swash plate supported on said rotary shaft for integral rotation with and inclining motion with respect to said rotary shaft, wherein said pistons draw said refrigerant into said cylinder bores from said suction chamber, compress said refrigerant and then discharge said refrigerant to said discharge chamber, and wherein the inclined angle of said swash plate is varied according to the pressure in said crank chamber and the displacement is altered according to the resulting inclined angle of said swash plate;

said supply passage connecting said discharge chamber to said crank chamber;

an electromagnetic valve disposed for changing the opening of said supply passage over a continuous range between two end positions;

a computer for controlling said electromagnetic valve in response to instructions to increase and instructions to decrease the displacement, said computer controlling said electromagnetic valve to enlarge the opening of said supply passage in response to instructions to decrease the displacement.

19. A compressor according to claim 18, wherein said electromagnetic valve includes:

a valve housing;

a solenoid provided within said valve housing;

a plunger actuated when a current is supplied to said solenoid;

a valve hole formed in said valve housing and connected to said supply passage; and a valve body for adjusting the opening of said valve hole in accordance with the activation of said plunger.

20. A compressor according to claim 19, wherein said computer controls the magnitude of the current supplied to said solenoid of said electromagnetic valve.

21. A compressor according to claim 18 further comprising:

a suction passage defined in said casing and connected to said suction chamber;

an external refrigerant circuit provided outside said casing for connecting said discharge chamber to said suction passage; and a shutter member movably supported by said casing for opening and closing said suction passage according to the movement of the shutter member, said shutter member moving in accordance with the inclining movement of said swash plate.

22. A compressor according to claim 19, further comprising:

a suction passage defined in said casing and connected to said suction chamber;

an external refrigerant circuit provided outside said casing for connecting said discharge chamber to said suction passage; and a shutter member movably supported by said casing for opening and closing said suction passage according to the movement of the shutter member, said shutter member moving in accordance with the inclining movement of said swash plate;

wherein said electromagnetic valve further includes:

a detection chamber defined between said solenoid and said valve hole in said valve housing for detecting the pressure of said refrigerant within said suction passage; and a pressure sensing member located in said detection chamber for transmitting the movement of said plunger, said pressure sensing member expanding and contracting in response to the pressure in said detection chamber.

23. A compressor according to claim 21, wherein said pressure release passage includes:

a passage formed in said rotary shaft; and a pressure release hole formed in said shutter member and connected to said passage.

24. A compressor according to claim 18, wherein the computer is coupled to means for sensing the temperature in a passenger compartment of a vehicle when the compressor is mounted on said vehicle.

25. A compressor according to claim 18, wherein:

said valve includes a valve body for changing the amount of opening of said supply passage;

a pressure sensing member is provided responsive to a suction pressure for transmitting variation of said suction pressure to said valve body; and a solenoid is provided for biasing said valve body when energized; wherein said computer controls the value of a current supplied to said solenoid such that the displacement is changed to a minimum level in response to minimum displacement instructions and wherein said computer controls the value of the current supplied to said solenoid to change the suction pressure.

26. A variable displacement compressor having a suction chamber, a discharge chamber and a pressure control chamber, the displacement of a refrigerant from the compressor being controlled by supplying said refrigerant via a supply passage from said discharge chamber to said pressure control chamber and delivering said refrigerant via a pressure release passage from said pressure control chamber to said suction chamber, wherein said displacement decreases when the pressure in said pressure control chamber increases and wherein said displacement increases when the pressure in said pressure control chamber decreases, said compressor further comprising:

changing means for changing the opening of said pressure release passage in a continuous manner between two end positions; and control means for controlling said changing means in response to instructions to increase and instructions to decrease the displacement, said control means controlling said changing means to reduce the opening of said pressure release passage in response to instructions to decrease the displacement.

27. A compressor according to claim 26 further comprising:

a casing having a discharge chamber and a suction chamber;

a crank chamber defined in said casing, said crank chamber serving as said pressure control chamber;

a plurality of cylinder bores formed in said casing, each cylinder bore being connected to said discharge chamber and said suction chamber;

a plurality of pistons accommodated in said cylinder bores;

a rotary shaft rotatably supported by said casing; and a swash plate supported on said rotary shaft for integral rotation with and inclining motion with respect to said rotary shaft, wherein said pistons draw said refrigerant into said cylinder bores from said suction chamber, compress said refrigerant and then discharge said refrigerant to said discharge chamber, and wherein the inclined angle of said swash plate is varied according to the pressure in said crank chamber and the displacement is altered according to the resulting inclined angle of said swash plate.

28. A compressor according to claim 27, wherein said changing means includes an electromagnetic valve located in said supply passage.

29. A compressor according to claim 28, wherein said control means includes a computer for controlling said electromagnetic valve.

30. A compressor according to claim 28, wherein said electromagnetic valve includes:

a valve housing;

a solenoid provided within said valve housing;

a plunger actuated when a current is supplied to said solenoid;

a valve hole formed in said valve housing and located in said supply passage; and a valve body for adjusting the opening of said valve hole in accordance with the activation of said plunger.

31. A compressor according to claim 30, wherein said control means includes a computer for controlling the magnitude of the current supplied to said solenoid of said electromagnetic valve.

32. A clutchless variable displacement compressor to be driven directly by a power source, said compressor comprising:

a casing having a discharge chamber and a suction chamber;

a crank chamber defined in said casing;

a plurality of cylinder bores formed in said casing, each cylinder bore being connected to said discharge chamber and said suction chamber;

a plurality of pistons each accommodated in a different one of said cylinder bores;

a rotary shaft rotatably supported by said casing;

a swash plate supported on said rotary shaft for integral rotation with and inclining motion with respect to said rotary shaft, wherein said pistons draw a refrigerant into said cylinder bores from said suction chamber, compress said refrigerant and then discharge said refrigerant to said discharge chamber, and wherein the inclined angle of said swash plate is varied according to the pressure in said crank chamber and the displacement is altered according to the resulting inclined angle of said swash plate;

a control passage connecting said crank chamber to at least one of said discharge chamber and said suction chamber;

changing means for changing the opening of said control passage, wherein the changed opening results in altering the pressure difference between the pressure in said crank chamber and the pressure in said cylinder bores, both pressures acting on said pistons, said pressure difference determining the inclined angle of said swash plate to change the stroke of each piston, thereby changing the displacement of the compressor, wherein said changing means includes:

a valve body for changing the opening of said supply passage;

a pressure sensing member responsive to a suction pressure for transmitting variation of said suction pressure to said valve body; and a solenoid for biasing said valve body when energized; and control means for controlling the amount of current supplied to said solenoid in a continuous manner between two end values in response to instructions to change the displacement, wherein said control means controls the amount of the current supplied to said solenoid such that the displacement is changed to a minimum level in response to minimum displacement instructions, and wherein said control means controls the value of the current supplied to said solenoid to change the suction pressure in response to a cooling demand.

33. A compressor according to claim 32 further comprising a shutter member for preventing said refrigerant from being delivered outside of the compressor.

34. A compressor according to claim 33, wherein said shutter member prevents said refrigerant from being delivered outside of the compressor when the displacement of the compressor is at the minimum.

35. A compressor according to claim 34, wherein said shutter member is actuated in accordance with the inclining movement of said swash plate.

36. A compressor according to claim 35 further comprising:

a suction passage provided within said casing and connected to said suction chamber; and a refrigerant circuit provided outside said casing for connecting said discharge chamber to said suction passage;

wherein said shutter member is movably supported in said casing to open and close said suction passage in accordance with the movement of the shutter member.

37. A compressor according to claim 32 further comprising a switch for activating the compressor, wherein said control means controls the value of the current supplied to said solenoid to change the displacement to the minimum in response to a turn-off signal from said switch.

38. A compressor according to claim 37, wherein said control means sets the value of the current to zero in response to the turn-off signal.

39. A compressor according to claim 32, wherein said control passage includes a supply passage for connecting said discharge chamber to said crank chamber and a pressure release passage for connecting said crank chamber to said suction chamber, and wherein said changing means is located at said supply passage and said valve body changes the opening of said supply passage.

40. A compressor according to claim 39, further comprising a switch for activating the compressor, wherein said control means controls the value of the current supplied to said solenoid to be zero to change the displacement to a minimum in response to a turn-off signal from said switch, and wherein said valve body maximizes the opening of said supply passage when said solenoid is de-energized.

41. A compressor according to claim 39 further comprising:

a suction passage provided within said casing and connected to said suction chamber;

a refrigerant circuit provided outside said casing for connecting said discharge chamber to said suction passage; and a shutter member movably supported in said casing for opening and closing said suction passage when moved in accordance with the inclining movement of said swash plate.

42. A compressor according to claim 41, wherein said pressure release passage includes a passage formed in said rotary shaft and a pressure release port formed in said shutter member and connected to said passage.

43. A method of operating a variable displacement compressor where the compressor has a plurality of pistons mounted in respective cylinder bores and reciprocated by rotation of a variably inclinable swash plate, the inclination of the swash plate being determined by the pressure within a crank chamber that houses the swash plate, and the pressure within the crank chamber being established by feeding compressed gas from a discharge chamber through a supply passage to the crank chamber and returning gas from the crank chamber to a suction chamber through a pressure release passage, said method comprising the steps of providing an electrically controlled valve for controlling the flow rate through one of said passages where said valve is continuously controllable in response to its electrical energization for controlling the flow rate between a minimum and a maximum value, and all values in-between, and controlling said valve with control means to control the energization of said valve to determine the displacement of said compressor.

* * * * *

UNITED STATES PATENT AND TRADEMARK OFFICE

CERTIFICATE OF CORRECTION

PATENT NO. : 5,865,604

DATED : February 2, 1999

INVENTOR(S) : Masahiro Kawaguchi, et al.

It is certified that error appears in the above-identified patent and that said Letters Patent is hereby corrected as shown below:

Column 8, line 24, before "area" insert --opened-- .

<u>In the Claims:</u>

Claim 19, line 7 and 8, change "connected to" to --located in--.

Signed and Sealed this

Fourteenth Day of September, 1999

*Attest:*

Q. TODD DICKINSON

*Attesting Officer*

*Acting Commissioner of Patents and Trademarks*